US007930795B1

(12) United States Patent
Johnston

(10) Patent No.: US 7,930,795 B1
(45) Date of Patent: Apr. 26, 2011

(54) WINDSHIELD SCRAPER HAVING AN ARM BRACE

(76) Inventor: Darren T. Johnston, Drumheller (CA)

( * ) Notice: Subject to any disclaimer, the term of this patent is extended or adjusted under 35 U.S.C. 154(b) by 580 days.

(21) Appl. No.: 12/075,157

(22) Filed: Mar. 11, 2008

(51) Int. Cl.
*A47L 13/08* (2006.01)
*A47L 13/12* (2006.01)

(52) U.S. Cl. ..... 15/236.02; 15/236.01; 15/143.1

(58) Field of Classification Search .. 15/236.01–236.08, 15/236.1
See application file for complete search history.

(56) References Cited

U.S. PATENT DOCUMENTS 4,888,846 A * 12/1989 Natale ..... 15/236.01
5,379,758 A * 1/1995 Snyder ..... 600/213
5,455,981 A * 10/1995 Wiese ..... 15/236.01
5,890,259 A * 4/1999 Sarac ..... 16/422
6,082,795 A * 7/2000 Fornelli ..... 294/58
6,598,266 B1 * 7/2003 Elliott ..... 16/430
* cited by examiner

*Primary Examiner* — Monica S Carter
*Assistant Examiner* — Stephanie Newton
(74) *Attorney, Agent, or Firm* — G. F. Gallinger

(57) ABSTRACT

A hand and arm manipulated scraper for a windshield comprising: a) a blade portion having a windshield contact edge portion and an opposite handle end; b) an elongate handle portion having a blade end portion, attached to the blade portion and an opposite grip end portion to be held with the hand; and, c) an arm brace portion terminating in an arm cover which covers a top side portion of the forearm extending therefrom down and the around the arm and having an inner end portion attaching to the grip end portion of the handle portion beneath the palm of one's hand. When the blade portion is pressed down on the windshield while the grip end portion is grasped beneath the palm of the hand, the wrist is prevented from bending up by downward pressure of the arm cover on the top side portion of the arm. In a preferred aspect of this invention the arm brace portion extends down and around opposite lateral sides of the arm so that when the blade portion is pressed down on the windshield the scraper does not tend to twist around the arm.

16 Claims, 1 Drawing Sheet

WINDSHIELD SCRAPER HAVING AN ARM BRACE

FIELD OF THE INVENTION

This invention relates to scraping ice and snow off vehicle windshields. More particularly this invention relates to a windshield ice scraper having an arm brace. The arm brace allows an individual to apply a greater force to the scraper by using the arm rather than the wrist.

BACKGROUND OF THE INVENTION

Sleet and ice accumulated on a windshield of a vehicle can be most difficult to remove, particularly when it is coldest. The conventional scraper comprising a blade portion attached to a handle portion is most effective when maximal downward pressure is applied by the blade on the ice. The problem with applying more pressure is that both one's wrist and hand are stained and become tired quickly, invariably before the windshield is fully scraped. The invention disclosed herein describes a more effective scraper. The scraper is more effective because approximately twice the downward pressure can be exerted on the ice on the windshield with this scraper. The scraper is also more effective because the pressure can be exerted for a much longer time without tiring the relatively smaller muscles in the wrist and the fingers of the hand. When an arm brace is added to the conventional scraper the upward twisting moment on the wrist no longer exists. The wrist does not tire! Furthermore, because all downward pressure is exerted from the lower arm the fingers need not convey this extreme downward pressure to the handle portion of the scraper. The fingers are only used to maintain the handle portion beneath the arm. Accordingly, the hand muscle also have relatively minimal exertion. Instead the downward force is generated by the large muscles of the arm. Because these muscles are a multiple of times larger than the muscles in the hand and the wrist, much more force can be exerted for a much greater duration of time. A scraper having an arm brace is not only needed to much more effectively and efficiently clean a windshield, most of the time it is needed to finish cleaning the windshield.

OBJECTS OF THE INVENTION

It is an object of this invention to disclose a windshield scraper having an arm brace. It is an object of this invention to disclose significantly more effective and efficient windshield scraper. It is yet a further object of this invention to disclose a windshield scraper which facilitates significantly more down ward pressure on an ice covered windshield. It is yet a further object of this invention to disclose a windshield scraper with which most downward pressure is generated from the large upper arm muscles and with which minimal downward pressure is exerted through the finger, hand, and arm muscles. It is final object of this invention to disclose a windshield scraper which can be used for relatively long periods of time because it minimally tires the muscles of an individual using the scraper.

One aspect of this invention provides for a hand and arm manipulated scraper for a windshield comprising: a) a blade portion having a windshield contact edge portion and an opposite handle end; b) an elongate handle portion having a blade end portion, attached to the blade portion and an opposite grip end portion to be held with the hand; and, c) an arm brace portion terminating in an arm cover which covers a top side portion of the arm extending therefrom down and the around the arm and having an inner end portion attaching to the grip end portion of the handle portion beneath the palm of one's hand. When the blade portion is pressed down on the windshield while the grip end portion is grasped beneath the palm of the hand, the wrist is prevented from bending up by downward pressure of the arm cover on the top side portion of the arm.

In a preferred aspect of this invention the arm brace portion extends down and around opposite lateral sides of the forearm so that when the blade portion is pressed down on the windshield the scraper does not tend to twist around the arm.

Various other objects, advantages and features of this invention will become apparent to those skilled in the art from the following description in conjunction with the accompanying drawings.

FIGURES OF THE INVENTION

Figure 1:
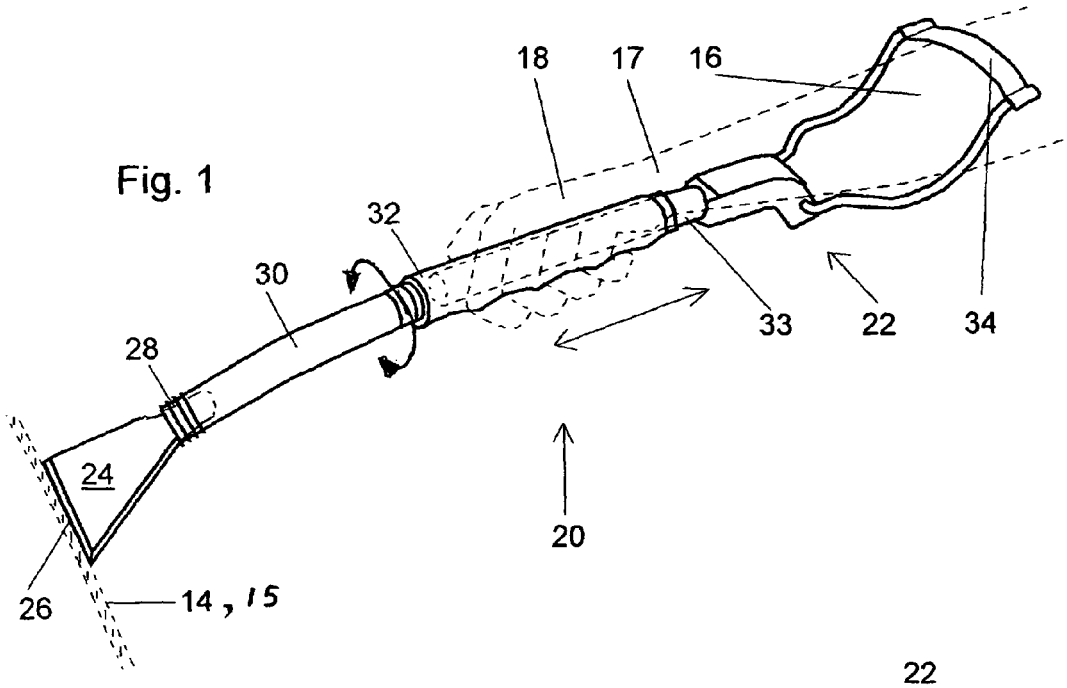
FIG. 1 is a perspective view of a tool head on an elongate handle having an arm brace.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a tool head 24 removably mounted in a tool head 24 end portion of an elongate handle portion 30 having an arm brace 22. Most generally, a hand and arm manipulated elongate tool 20 comprises: a) a tool head 24 having an opposite handle end; b) an elongate handle portion 30 having a tool head end portion, attached to the handle end of the tool head 24 and having an opposite grip end portion 32 to be held with the hand 18; and, c) an arm brace portion 22 terminating in an arm cover 34 which covers a top side portion of the arm 16. The arm brace portion 22 extends down and the around the arm 16 and has an inner end portion attaching to the grip end portion 32 of the handle portion 30 beneath the palm of one's hand 18. When the tool head 24 is pressed down while the grip end portion 32 is grasped beneath the palm of the hand 16, the wrist 17 is prevented from bending up by downward pressure of the arm cover 34 on the top side portion of the arm 16.

Most preferably the tool head 24 removably and non-rotably slides into the elongate handle portion 30 so that the tool 20 can be used with different tool heads 24 for different applications. It is contemplated that the tool 20 would have particular application when the tool head 24 comprised a brush, an abrasive head or any other tool for scrubbing (none shown). In a preferred embodiment of the invention the elongate handle 30 is rotatable in and with respect to the grip end portion 32 thereof to facilitate moving the tool head 24 around curved surfaces 14 without twisting the arm 16. In yet another embodiment of the invention the elongate handle portion 30 is slidable within the grip end portion 32 to accommodate varying arms 16 lengths.

Most generally, a hand 18 and arm 16 manipulated windshield scraper 20 comprises: a) a blade portion 25 having a windshield contact edge portion 26 and an opposite handle end 28; b) an elongate handle portion 30 having a blade end portion which is attached to the blade portion 25, and an opposite grip end portion 32 to be held with the hand 18; and, c) an arm brace portion 22 terminating in an arm cover 34 which covers a top side portion of the arm 16 extending therefrom down and the around the arm 16 and having an inner end portion attaching to the grip end portion 32 of the handle portion 30 beneath the palm of one's hand 18. When the blade portion 25 is pressed down on the windshield 14 while the grip end portion 32 is grasped beneath the palm of the hand 18, the wrist 17 is prevented from bending up by downward pressure of the arm cover 34 on the top side portion of the arm 16.

In the most preferred embodiment of the invention the arm brace portion 22 extends down and around opposite lateral sides of the arm 16 so that when the blade portion 25 is pressed down on the windshield 15 the scraper 20 does not tend to twist around the arm 16. In another embodiment of the invention the inner end portion attaching to the grip end portion 32 of the handle portion 30 slidingly and lockably receives an elongated inner end portion 33 of the arm brace portion 22 of the scraper 20 so that the scraper 22 is adjustable thereby for varying arm 18 lengths. In yet another embodiment of the invention the grip end portion 32 receives an elongated inner end portion of the handle portion 30 and the elongated inner end portion 33 is rotatable therein so that the blade portion 25 may follow a curved windshield 14, or other curved surface 15 without the need for the wrist 17 to turn from an optimal degree of rotation.

Figure 2:
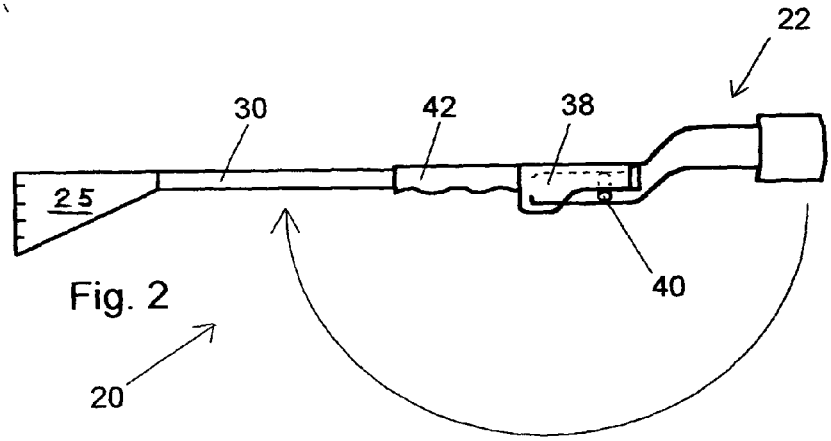
FIG. 2 is a perspective view of another embodiment of a windshield scraper having an arm brace portion wherein the arm brace portion thereof can pivot around under the scraper to a folded storage position.
Figure 3:
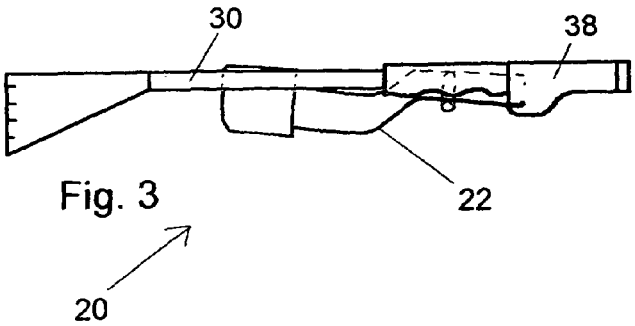
FIG. 3 is a perspective view of the embodiment of the invention shown in FIG. 2 wherein the arm brace portion is in a folded close storage position.

FIG. 2 is a perspective view of another embodiment of the windshield scraper 20 having an arm brace 22 portion wherein the arm brace portion 22 thereof can pivot around under the scraper 20 to a folded storage position. FIG. 3 is a perspective view of the embodiment of the invention shown in FIG. 2 wherein the arm brace portion 22 is in a folded close storage position. Most preferably a storage hinge member 38 having one side portion attached to the inner end portion 33 of the arm brace portion 22 and the other hinge side portion connected to the grip end portion 32 of the elongate handle portion 32 of the scraper 20 is shown in FIG. 2. Said hinge sides are restrained from bending upwardly so that upward bending of the wrist 17 is prevented, but allowed to bend downwardly so that the brace portion 22 can be rotated beneath the elongate handle 30 portion for storage. Most preferably the hinge 38 comprises an attached pivot end portion containing a pivot 40, and a laterally extending opposite cover end portion, and wherein one of the grip end portion 32 of the handle portion 30 and inner end portion 33 of the arm brace portion 22, is the attached pivot 40 end portion; and the other of the grip end portion 32 of the handle portion 22 and the inner end portion 33 of the arm brace portion 22 is attached to the pivot 40. In the most preferred embodiment of the invention the attached pivot end portion of the hinge 40 is attached to the grip end portion 32 of the handle portion 30 and the inner end portion 33 of the arm brace portion 22 is attached to the pivot 40.

In the most preferred embodiment of the invention the arm brace portion 22 which extends down and around the opposite lateral sides of the arm comprises steel having a solid cross section. The elongate handle portion 30 comprises tubing having a circular cross section. The grip end portion 32 of the handle portion 30 can further comprise a plastic sleeve 42 covering for an improved grip thereon.

While the invention has been described with preferred specific embodiments thereof, it will be understood that this description is intended to illustrate and not to limit the scope of the invention, which is defined by the following claims.

I claim:

1. A hand and arm manipulated elongate tool comprising:

a) a tool head having an opposite handle end;

b) an elongate handle portion having a tool head end portion, attached to the handle end of the tool head and an opposite grip end portion to be held with the hand; and, c) an arm brace portion terminating in an arm cover which covers a top side portion of the arm extending therefrom down and the around the arm and having an inner end portion attaching to the grip end portion of the handle portion beneath the palm of one's hand;

d) a storage hinge member having one side portion attached to the inner end portion of the arm brace portion and the other hinge side portion connected to the grip end portion of the elongate handle portion of the scraper said hinge sides restrained from bending upwardly so that upward bending of the wrist is prevented, but allowed to bend downwardly so that the brace portion can be rotated beneath the elongate handle portion for storage;

so that when the tool head is pressed down while the grip end portion is grasped beneath the palm of the hand, the wrist is prevented from bending up by downward pressure of the arm cover on the top side portion of the arm.

2. A tool as in claim 1 wherein the tool head removably and non-rotatably slides into the elongate handle portion so that the tool can be used with different tool heads for different applications.

3. A tool as in claim 1 wherein the tool end portion of the elongate handle is rotatable with respect to the grip end portion thereof to facilitate moving the tool head around curved surfaces without twisting the arm.

4. A tool as in claim 3 wherein the elongate handle portion is rotatable within the grip end portion.

5. A hand and arm manipulated scraper for a windshield comprising:

a) a blade portion having a windshield contact edge portion and an opposite handle end;

b) an elongate handle portion having a blade end portion, attached to the blade portion and an opposite grip end portion to be held with the hand; and, c) an arm brace portion terminating in an arm cover which covers a top side portion of the arm extending therefrom down and the around the arm and having an inner end portion attaching to the grip end portion of the handle portion beneath the palm of one's hand;

d) a storage hinge member having one side portion attached to the inner end portion of the arm brace portion and the other hinge side portion connected to the grip end portion of the elongate handle portion of the scraper said hinge sides restrained from bending upwardly so that upward bending of the wrist is prevented, but allowed to bend downwardly so that the brace portion can be rotated beneath the elongate handle portion for storage;

so that when the blade portion is pressed down on the windshield while the grip end portion is grasped beneath the palm of the hand, the wrist is prevented from bending up by downward pressure of the arm cover on the top side portion of the arm.

6. An apparatus as in claim 5 wherein the arm brace portion extends down and around opposite lateral sides of the forearm so that when the blade portion is pressed down on the windshield the scraper does not tend to twist around the arm.

7. An apparatus as in claim 5 wherein the inner end portion attaching to the grip end portion of the handle portion slidingly and lockably receives an elongated inner end portion of the arm brace portion of the scraper so that the scraper is adjustable thereby for varying arm lengths.

8. An apparatus as in claim 7 wherein the elongated inner end portion received in the grip end portion is rotatable therein so that the blade portion may follow a curbing windshield without the need for the wrist to turn from an optimal degree of rotation.

9. An apparatus as in claim 5 wherein the elongate handle portion comprises tubing having a circular cross section.

10. An apparatus as in claim 4 wherein the hinge comprises an attached pivot end portion containing a pivot, and a laterally extending opposite cover end portion, and wherein one of the grip end portion of the handle portion and inner end portion of the arm brace portion, is the attached pivot end portion; and the other of the grip end portion of the handle portion and the inner end portion of the arm brace portion is attached to the pivot.

11. An apparatus as in claim 10 wherein the attached pivot end portion of the hinge is attached to the grip end portion of the handle portion and the inner end portion of the arm brace portion is attached to the pivot.

12. An apparatus as in claim 2 wherein the arm brace portion extending down and around the opposite lateral sides of the forearm comprises steel having a solid cross section.

13. An apparatus as in claim 2 wherein the elongate handle portion comprises tubing having a circular cross section.

14. An apparatus as in claim 8 further comprising a plastic sleeve covering the grip end portion of the handle portion for an improved grip thereon.

15. An apparatus as in claim 5 wherein the hinge comprises an attached pivot end portion containing a pivot, and a laterally extending opposite cover end portion, and wherein one of the grip end portion of the handle portion and inner end portion of the arm brace portion, is the attached pivot end portion; and the other of the grip end portion of the handle portion and the inner end portion of the arm brace portion is attached to the pivot.

16. An apparatus as in claim 15 wherein the attached pivot end portion of the hinge is attached to the grip end portion of the handle portion and the inner end portion of the arm brace portion is attached to the pivot.

* * * * *